US010483656B2

(12) United States Patent
Yu et al.

(10) Patent No.: US 10,483,656 B2
(45) Date of Patent: Nov. 19, 2019

(54) DUAL-NOTCH ANTENNA AND ANTENNA ARRAY THEREOF

(71) Applicant: CUBTEK INC., Hsinchu County (TW)

(72) Inventors: San-Chuan Yu, Hsinchu County (TW); Shyh-Jong Chung, Hsinchu County (TW); Ching-Han Tsai, Hsinchu County (TW); Bo-Yi Wang, Hsinchu County (TW)

(73) Assignee: CUBTEK INC., Zhubei, Hsinchu County (TW)

( * ) Notice: Subject to any disclaimer, the term of this patent is extended or adjusted under 35 U.S.C. 154(b) by 20 days.

(21) Appl. No.: 15/694,305

(22) Filed: Sep. 1, 2017

(65) Prior Publication Data

US 2019/0074599 A1 Mar. 7, 2019

(51) Int. Cl.

| | |
|---|---|
| ***H01Q 21/06*** | (2006.01) |
| ***H01Q 21/00*** | (2006.01) |
| ***H01Q 1/32*** | (2006.01) |

(52) U.S. Cl.

CPC ..... *H01Q 21/065* (2013.01); *H01Q 1/3233* (2013.01); *H01Q 21/0075* (2013.01)

(58) Field of Classification Search

CPC . H01Q 21/065; H01Q 1/3233; H01Q 21/0075
See application file for complete search history.

(56) References Cited

U.S. PATENT DOCUMENTS

| | | | | |
|---|---|---|---|---|
| 4,180,817 | A * | 12/1979 | Sanford | H01Q 13/206 342/375 |
| 4,291,312 | A * | 9/1981 | Kaloi | H01Q 1/48 343/700 MS |
| 6,211,825 | B1 * | 4/2001 | Deng | H01Q 1/38 343/700 MS |
| 2005/0156787 | A1 * | 7/2005 | Myoung | H01Q 1/38 343/700 MS |
| 2014/0145909 | A1 | 5/2014 | Chen et al. | |
| 2016/0033632 | A1 * | 2/2016 | Searcy | G01S 7/03 342/153 |

* cited by examiner

*Primary Examiner* — Dameon E Levi
*Assistant Examiner* — David E Lotter
(74) *Attorney, Agent, or Firm* — Muncy, Geissler, Olds & Lowe, P.C.

(57) ABSTRACT

A dual-notch antenna includes a radiation member and two microstrip lines. The radiation member is formed in a rectangular shape, with two first lateral sides disposed in opposite, and two second lateral sides disposed on two ends of the two first sides, respectively. The middle section of each first lateral side is concavely provided with a notch. Each notch has a feeding side and two cove sides, wherein the feeding side is disposed in parallel to the first lateral sides. The two cove sides are connected with two ends of the feeding side. Each microstrip line has one end thereof electrically connected with the feeding side of the corresponding notch, respectively.

10 Claims, 7 Drawing Sheets

DUAL-NOTCH ANTENNA AND ANTENNA ARRAY THEREOF

BACKGROUND OF THE INVENTION

1. Field of the Invention

The present invention relates to antenna and antenna array, and more particularly, to a dual notch antenna and antenna array thereof efficiently increasing the impedance bandwidth.

2. Description of the Related Art

Typically, most of vehicle radar system applies a microstrip antenna array, with a wireless signal transceiver of the vehicle radar system disposed inside a vehicle bumper or a fan guard. The vehicle radar system transmits and receives millimeter-wave wireless signal for carrying out application such as distance detection or information exchange. Because a vehicle bumper is usually provided with a shock absorbing Styrofoam or fiberglass therein, the internally available space is limited. As a result, the radar signal is easily attenuated, causing a designing difficulty of the antenna array.

Also, typical vehicle radar system operates in a frequency band between 24 GHz to 77 GHz. Increasing the antenna performance and raising the antenna gain at a high frequency is difficult. In addition, the available space limitation is to be considered. Therefore, the difficulty of the antenna designing is increased.

Furthermore, US2014/0145909A1 discloses an antenna and array antenna, comprising a radiation member; a grounding element forming an area, wherein the radiation is disposed in the area, and an opening is formed near the fourth side of the radiating element; an extending bar, electrically connected to the fourth side of the radiating element, and extended toward the opening of the grounding element; a first connection element, having one terminal connected to the first side and the fourth side of the radiating element, and another terminal electrically connected to the grounding and feed-in element; and a second connection element, having one terminal electrically connected to the third side and the fourth side of the radiating element, and another terminal electrically connected to the grounding and feed-in element.

The fourth side of the radiation element above is provided with a concave structure and electrically connected with the extending bar. However, as shown by the reflection coefficient frequency response diagram, the effective bandwidth of the antenna at a frequency about 24 GHz is not optimal, failing to achieve a preferably impedance match for avoiding the signal reflection. Also, the fourth side of the radiation has a concave structure. In the basic antenna theory, relative structural design has been mentioned for increasing bandwidth. However, such structure is not suitable for antenna array.

Therefore, it is desirable to increase the antenna efficiency and impedance bandwidth thereof.

SUMMARY OF THE INVENTION

For improving the issues above, an embodiment of the present invention discloses a dual-notch antenna and the antenna array thereof, which are able to efficiently increase the impedance bandwidth and applicable to array antenna, so as to optimize the antenna radiation pattern.

An embodiment of the dual-notch antenna, comprising:

a radiation member formed in a rectangular shape, with two first lateral sides disposed in opposite, and two second lateral sides disposed on two ends of the two first sides, so as to form the rectangular shape, a middle section of each first lateral side concavely provided with a notch, each of the two notches provided with a feeding side and two cove sides, the feeding side be disposed in parallel to the two first lateral sides, the two cove sides connected with two ends of the feeding side; and two microstrip lines, with one end of each microstrip line electrically connected with the feeding side of the two notches, respectively.

In another embodiment of the present invention, a plurality of radiation members and microstrip lines are applied, wherein each microstrip line is electrically connected with the feeding side of each radiation member, such that the radiation members are connected in series to form a string array.

With such configuration, with the notches concavely disposed on the two first lateral sides of each radiation member, the microstrip line is allowed to be inserted into the notch with a certain length, so as to be electrically connected with the feeding side at a proper position. Therefore, an optimal impedance match is provided, thus avoiding signal reflection.

Also, the two first lateral sides of each radiation member are concavely provided with a notch, respectively, so as to adjust the feeding impedance of each antenna and increase the effective frequency of the antenna.

Furthermore, by arranging the radiation members in series and forming a string array, external frequency bandwidth is effectively increased, so that an optimal impedance match is achieved, thus optimizing the antenna radiation pattern.

DETAILED DESCRIPTION OF THE INVENTION

Figure 1:
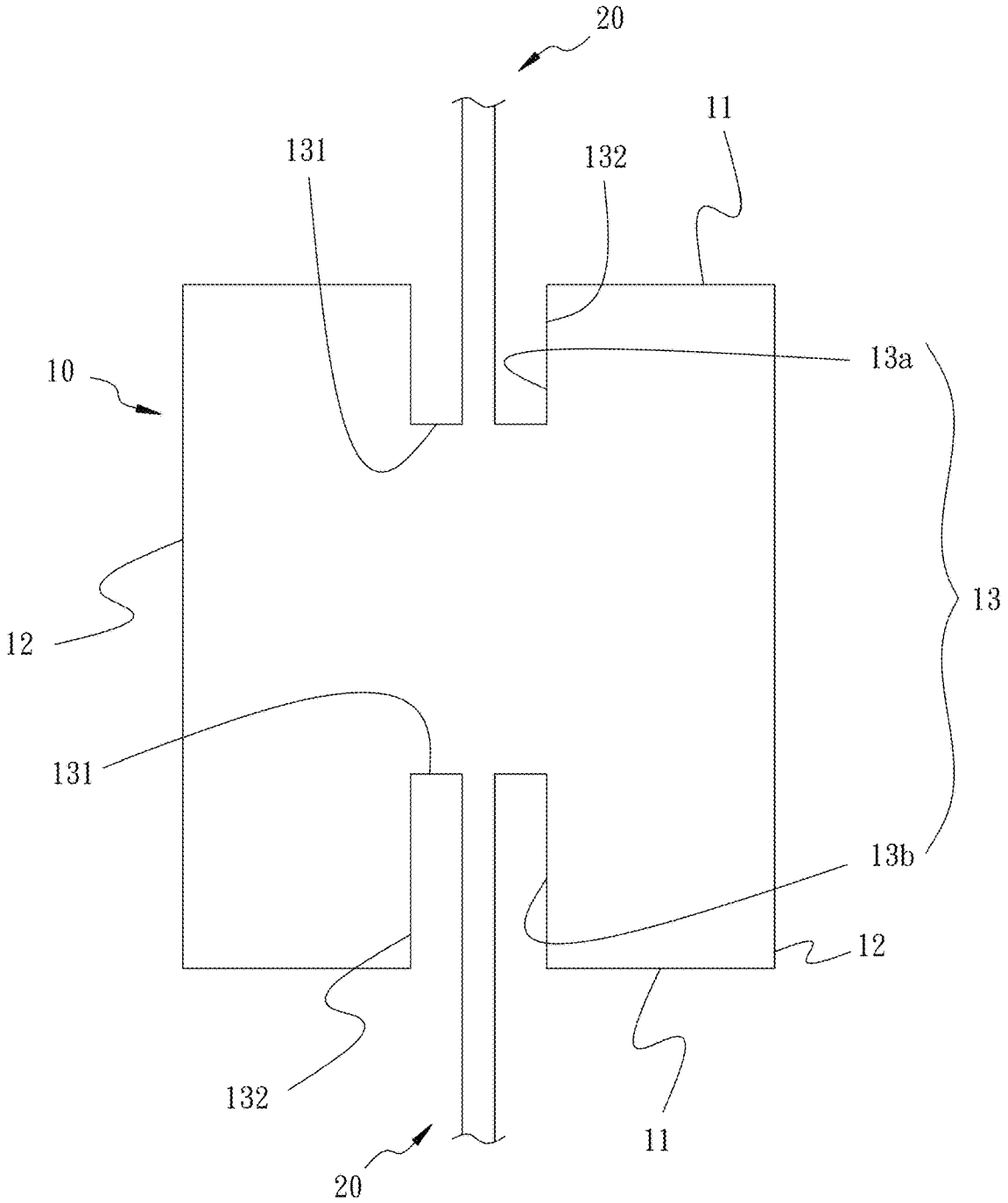
FIG. 1 is a schematic view illustrating the antenna in accordance with an embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1, FIG. 5, FIG. 6, and FIG. 7, an embodiment of the present invention provides a dual-notch antenna. In an embodiment, the dual-notch antenna refers to a microstrip antenna. The dual-notch antenna is disposed on a circuit board 1, comprising a substrate layer 2 and a grounding layer 3 that are stacked. The substrate layer 2 is provided with a first face 4 and a second face 5 disposed in opposite to the first face 4. The dual-notch antenna is disposed on the first face 4, and the grounding layer 3 is disposed on the second face 5. The dual-notch antenna comprises a radiation member 10 and two microstrip lines 20.

The radiation member 10 is formed in a rectangular shape, with two first lateral sides 11 disposed in opposite, and two second lateral sides 12 disposed on two ends of the two first lateral sides 11, so as to form the rectangular shape of the radiation member 10. Each of the two first lateral sides 11 has a notch 13 disposed at the middle section thereof. Each of the two notches 13 is provided with a feeding side 131 disposed in parallel to the two corresponding first lateral sides 11, and two cove sides 132 connected with the two ends of the feeding sides 131, respectively. In an embodiment of the present invention, the two cove sides 132 are disposed in parallel with the two second lateral sides 12, and also disposed in vertical to the feeding side 131. With such configuration, the two notches 13 are allowed to adjust the feeding impedance bandwidth of the dual-notch antenna.

Also, the second lateral side 12 is 1 to 2 times the length of the first lateral side 11. In other words, the minimum length of the second lateral side 12 is equal to the length of the first lateral side 11, and the maximum length of the second lateral side 12 is equal to 2 times the length of the first lateral side 11. In an embodiment, the length of the first lateral side 11 ranges between 2.5 to 5.5 times the length of the feeding side 131, wherein the length of the first lateral side 11 ranges from 1.5 to 3.5 millimeters. The length of the second lateral side 12 ranges from 3.5 to 5 times the length of the cove side 132, and the length of the cove side 132 is larger than the length of the feeding side 131. In an embodiment, the length of the first lateral side 11 is chosen from 1.8 millimeters, 2 millimeters, 2.5 millimeters, or 3 millimeters; the length of the second lateral side 12 is 3.355 millimeters; the length of the feeding side 131 is 0.6 millimeters.

Further, in an embodiment, the two notches 13 includes a first notch 13*a* and a second notch 13*b*. The length of the cove sides 132 of the first notch 13*a* is different from the length of the cove sides 132 of the second notch 13*b*, wherein the length of the cove sides 132 of the first notch 13*a* is 0.7 millimeters, and the length of the cove sides 132 of the second notch 13*b* is 0.85 millimeters.

Each of the two microstrip lines 20 has one end thereof electrically connected with the feeding side 131 of a corresponding notch 13, respectively, wherein one of the microstrip lines 20 is applied as an input end 20*a*, another the other microstrip line 20 is applied as an output end 20*b*. In an embodiment, the end of the microstrip 20 electrically connected with the feeding side 131 is arranged in vertical to the feeding side 131, wherein the length of the feeding side 131 ranges from 2.5 times to 3.5 times the width of the microstrip line 20. In the embodiment, the width of the microstrip line 20 is 0.2 millimeters. Therefore, each microstrip line 20 is allowed to be inserted with by a certain degree thereof into the corresponding notch 13 and electrically connected with the feeding side 131 at a proper position, so as to achieve the most preferred impedance match.

Figure 7:
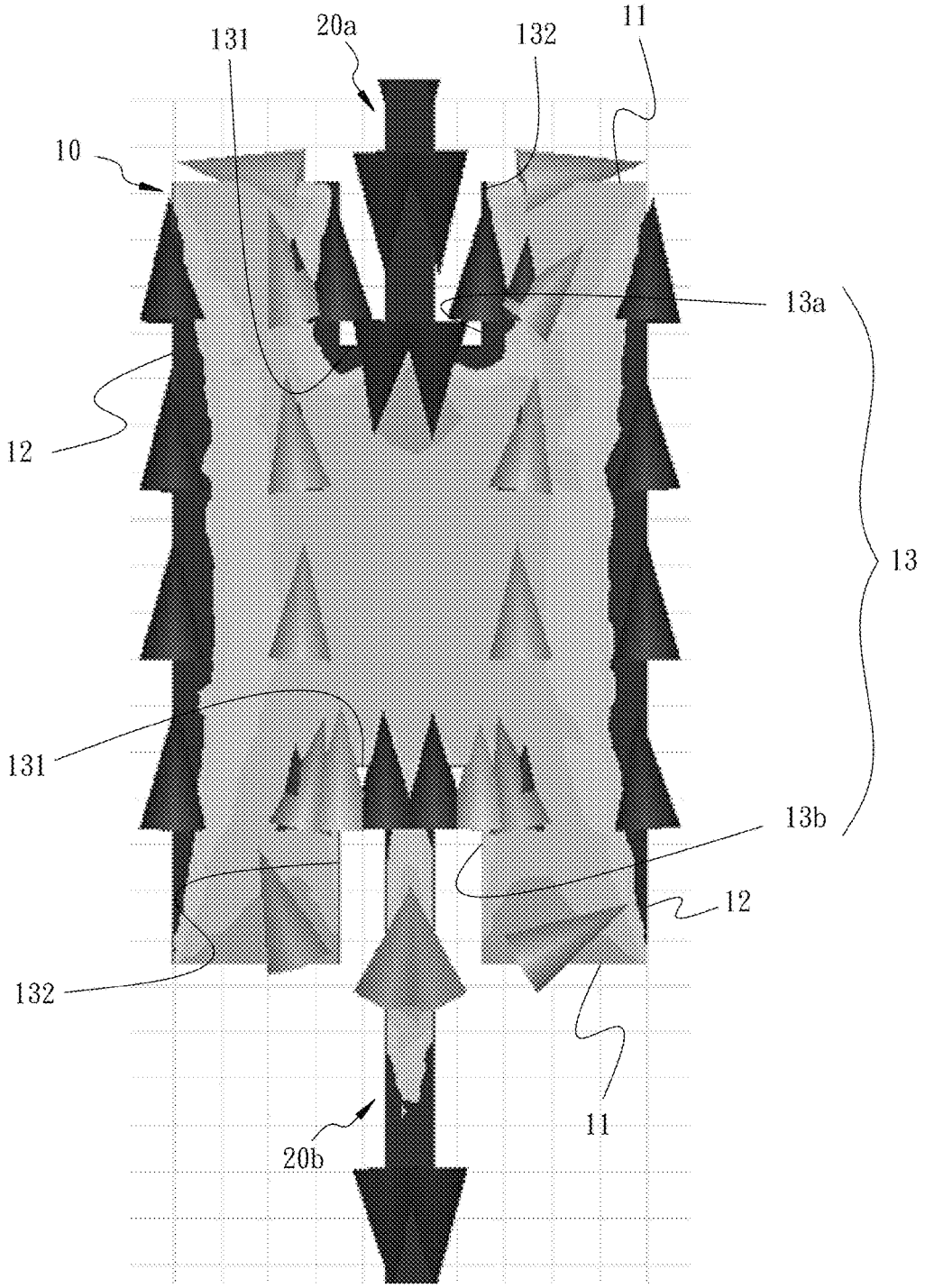
FIG. 7 is a schematic view illustrating the density of current vector of the radiation member in accordance with the present invention.

Referring to FIG. 7, with the specified size arrangement of the radiation member 10 and the two notches 13, the two second lateral sides 12 and the two notches 13 of the radiation member 10 is provided with high intensity current, so as to increase the radiation efficiency of the radiation member 10. In addition, the current direction on the two second lateral sides 12 are in opposite to the current direction on the two microstrip lines 20. Therefore, an optimal impedance match is achieved.

Figure 2:
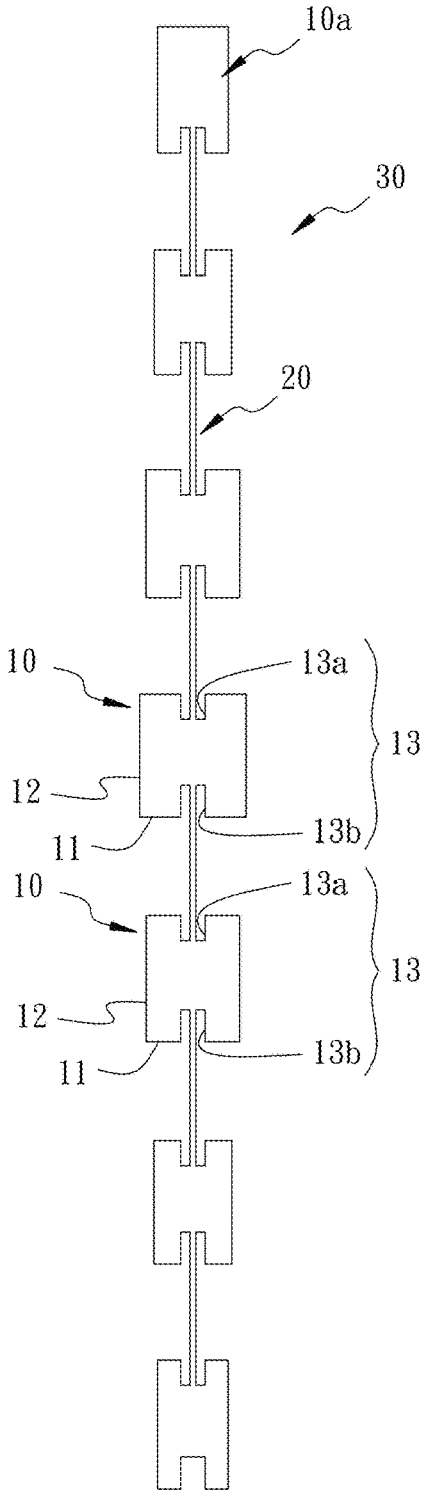
FIG. 2 is a schematic view illustrating the antenna array in accordance with an embodiment of the present invention.
Figure 3:
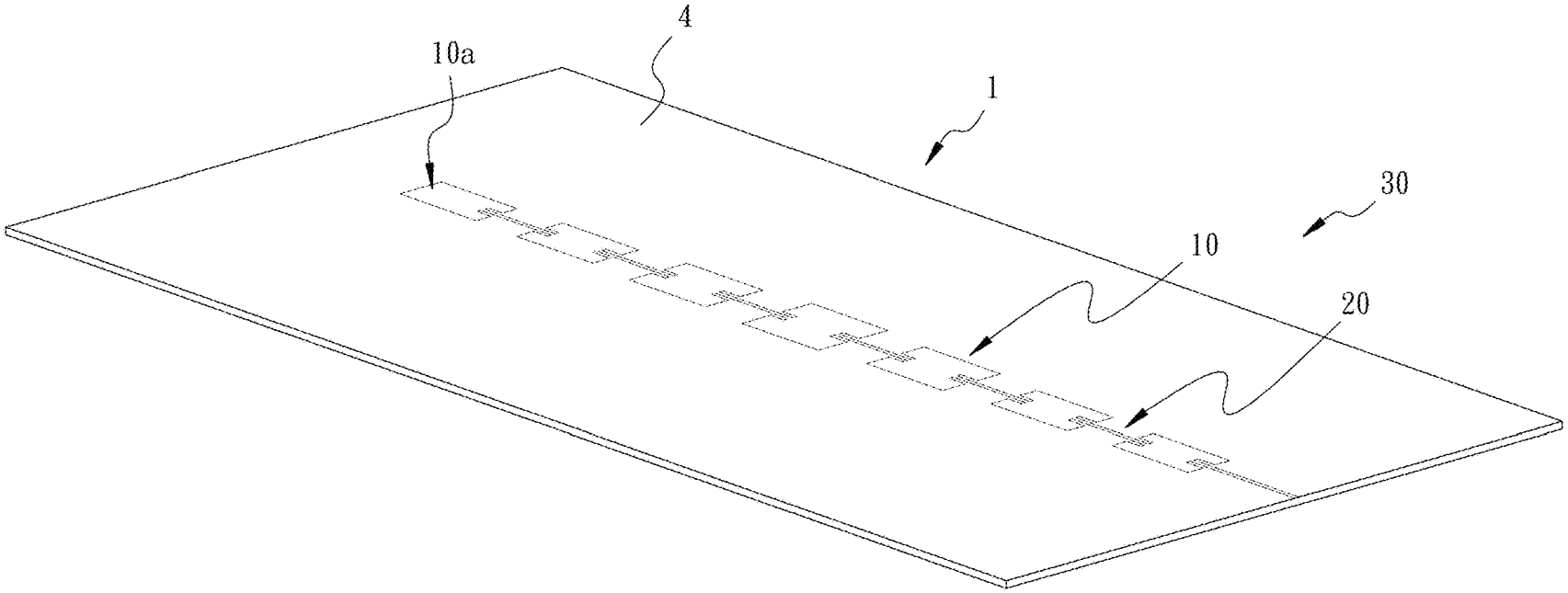
FIG. 3 is a schematic view illustrating the antenna array disposed on the substrate.
Figure 4:
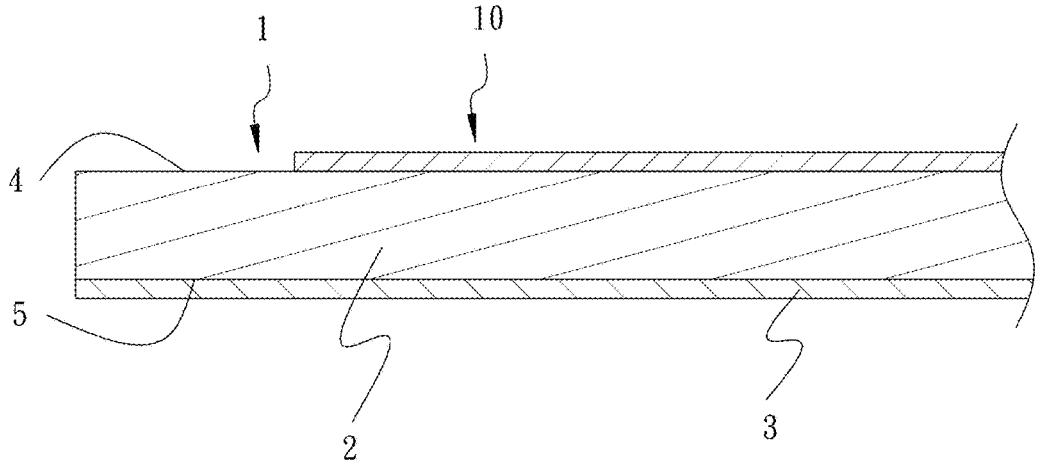
FIG. 4 is a partially sectional view of the FIG. 3.

Referring to FIG. 2 to FIG. 6, the dual-notch antenna is applied to form an antenna array. Besides lowering the square measure demand, various antenna effects are achievable through adjustment. In another embodiment of the present invention, the dual-notch antenna array is disposed on the first face 4 of the substrate layer 2 of the circuit board 1, as shown by FIG. 3 and FIG. 4.

The dual-notch antenna array comprises a plurality of radiation members 10 and a plurality of microstrip lines 20. Each of the two first lateral sides 11 of the radiation member 10 is concavely provided with a notch 13. Each of the microstrip lines 20 are electrically connected with the corresponding feeding side 131 of each radiation member 10, respectively, such that the radiation members 10 are connected in series to form a string array 30. As shown by FIG. 2, in an embodiment of the present invention, the first notch 13*a* of a radiation member 10 faces the second notch 13*b* of the neighboring radiation member 10.

Further, the length of the first lateral sides 11 of the two radiation members 10 on two distal ends of the string array 30 is smaller than the length of the first lateral sides 11 of the radiation members 10 that are disposed closed to the center of the string array 30. Also, from the radiation member 10 at the center of the string array 30 toward the two radiation members 10 at the two distal ends of the string array 30, the lengths of the first lateral sides 11 of each radiation member 10 are gradually decreased, such that the radiation member 10 at the center of the string array 30 has the longest first lateral sides 11, and the radiation members 10 at the two distal ends have the shortest first lateral sides 11. The length of the first lateral side 11 ranges between 1.5 to 3.5 millimeters. In the embodiment, the length of the first lateral sides 11 of each radiation member 10 is chosen from a combination including 1.8 millimeters, 2 millimeters, 2.5 millimeters, and 3 millimeters.

Referring to FIG. 2, in an embodiment of the present invention, the string array 30 includes six radiation members 10 provided with two notches 13 and one radiation member 10*a* provided with one notch 13. As shown in the figure and counted from the top of the string array 30, the first radiation member 10*a* has only one notch 13, and the length of the first lateral sides 11 thereof is 1.8 millimeters; the fourth radiation member 10 is disposed at the center of the string array 30, and the length of the first lateral side 11 thereof is 3 millimeters; the length of the first lateral sides 11 of the second and the sixth radiation members 10 is 2 millimeters; the length of the first lateral sides 11 of the third and the fifth radiation members 10 is 2.5 millimeters; and the length of the first lateral sides 11 of the seventh radiation member 10 is 1.8 millimeters.

Figure 5:
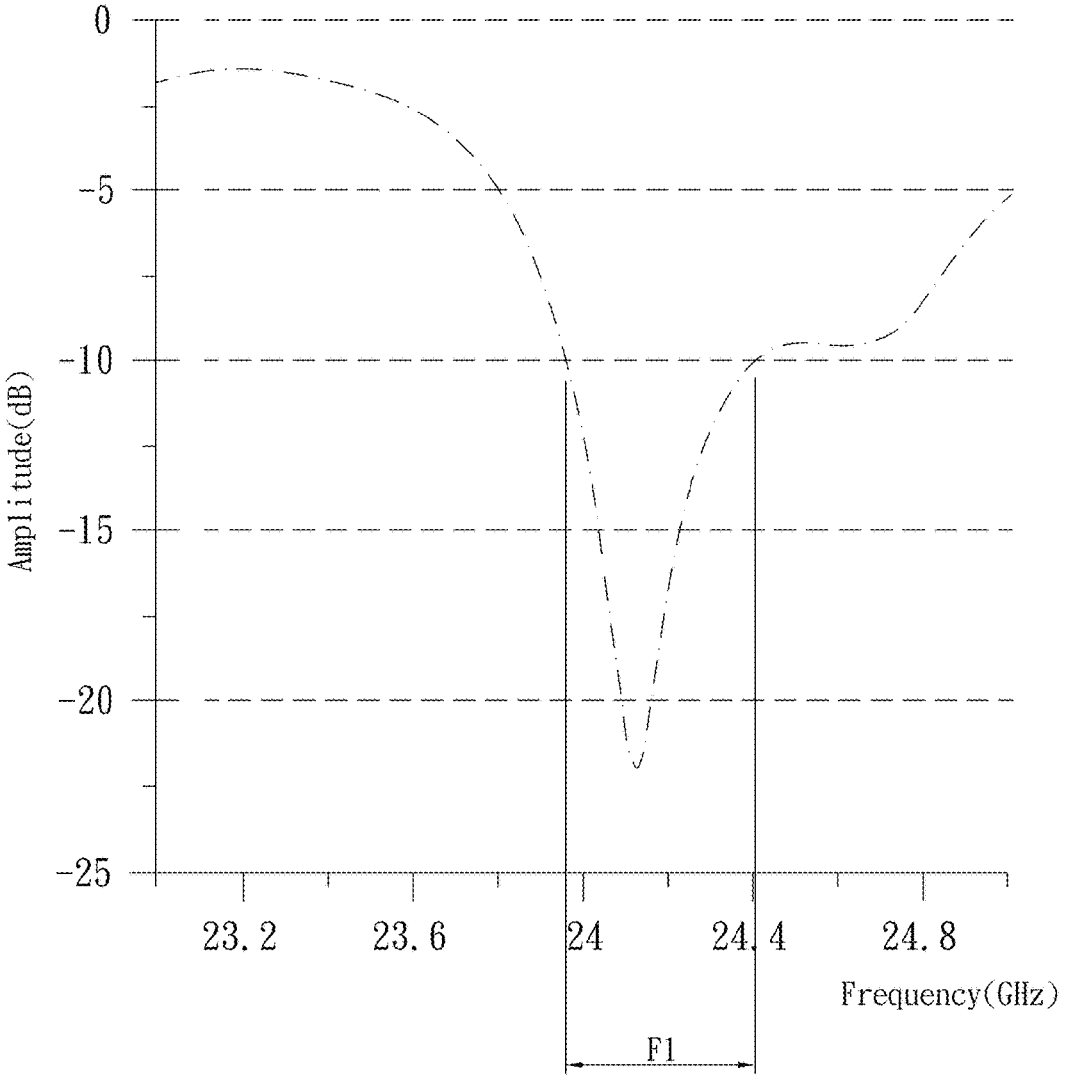
FIG. 5 is a reflection coefficient frequency response diagram.

Therefore, referring to FIG. 1 and FIG. 5, with the specific sizes of the radiation member 10 and the two notches 13, when the reflection coefficient curve lowers to −10 dB (Return Loss 10 dB), the impedance bandwidth F1 of the frequency difference around the operational frequency of 24 GHz is wider, as shown by FIG. 5. In an embodiment of the present invention, the impedance bandwidth F1 ranges from 23.9592 GHz to 24.4017 GHz.

Figure 6:
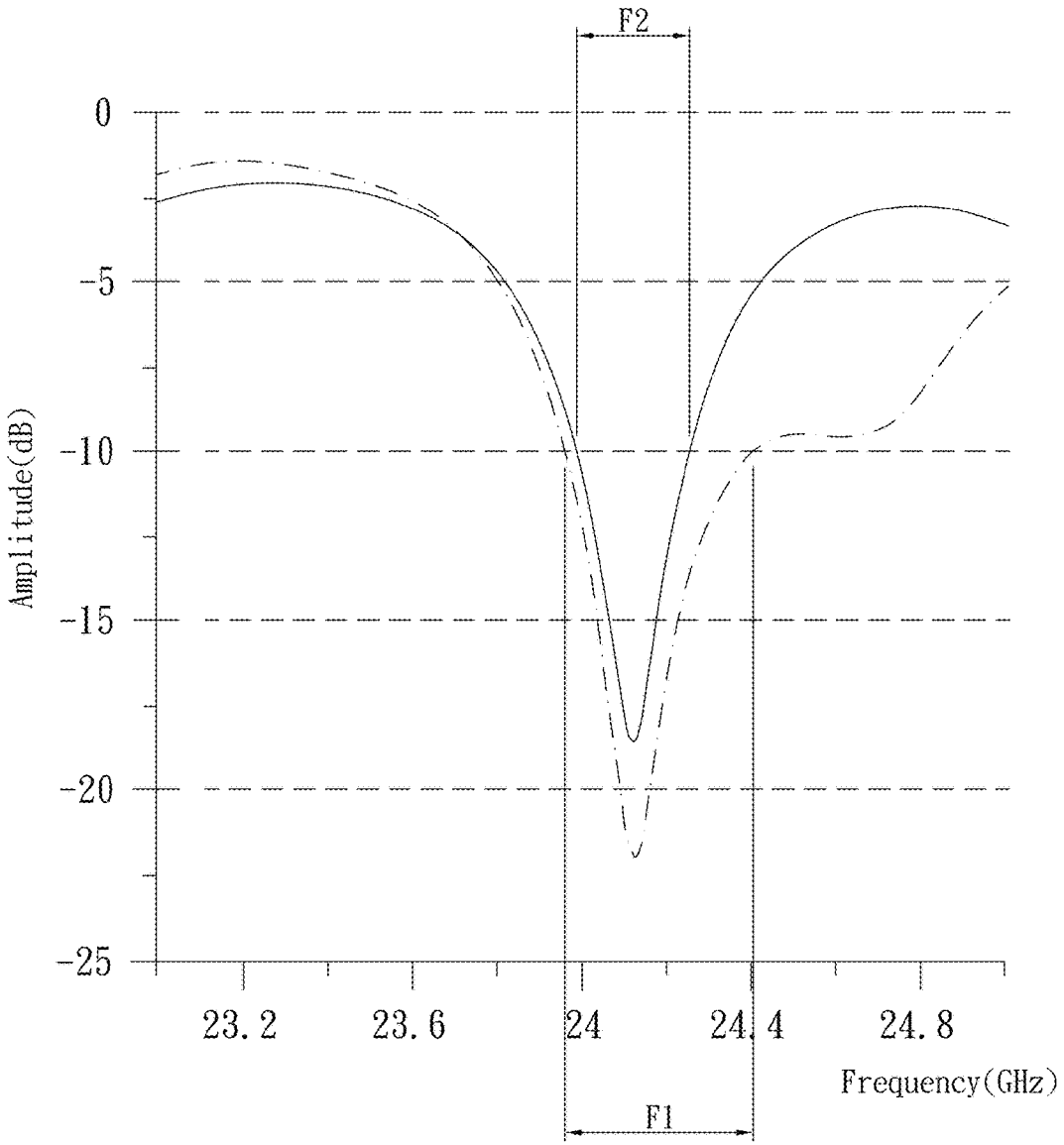
FIG. 6 is a schematic diagram illustrating the comparison between the reflection coefficient frequency response diagrams of the antenna array in accordance with the present invention and a conventional antenna array.

Furthermore, FIG. 6 shows the comparison between the reflection coefficient frequency response diagram of the dual-notch antenna array and a conventional antenna array. Clearly, the impedance bandwidth F1 of the dual-notch antenna array in accordance with the present invention is wider than the impedance bandwidth F2 of the conventional antenna array. Therefore, the dual-notch antenna array efficiently increases the impedance bandwidth to achieve an optimal antenna frequency pattern Therefore, the two notches 13 of the radiation member 10 allows the microstrip lines 20 to be inserted into the notches 13 with a proper length and electrically connected with the feeding side 131, achieving an optimal impedance match and preventing signal reflections. Also, the two notches 13 of the radiation member 10 adjust the feeding impedance of each radiation members 10, efficiently increasing the effective bandwidth.

Additionally, the dual-notch antenna is allowed to be applied as an antenna array, so as to efficiently lower the square measure demand, and achieve various antenna functions through the adjustment. By connecting radiation members 10 in series to form a string array 30, external frequency bandwidth is improved to acquire an optimal impedance match.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A dual-notch antenna, comprising: a plurality of radiation members, each of the radiation members formed in a rectangular shape, with two first lateral sides disposed in opposite, and two second lateral sides disposed on two ends of the two first sides, respectively, so as to form the rectangular shape, a middle section of each first lateral side concavely provided with a notch, each of the two notches provided with a feeding side and two cove sides, the feeding side disposed in parallel to the two first lateral sides, the two cove sides connected with two ends of the feeding side; and a plurality of microstrip lines, each microstrip line electrically connected with one of the corresponding feeding sides of the radiation member, such that the plurality of radiation members are connected in series to form a string array; lengths of the first lateral sides between each radiation member from a center of the string array toward the two radiation members at two distal ends of the string array being gradually decreased, such that the radiation member at the center of the string array has the longest first lateral sides, and the radiation members at the two distal ends of the string array have the shortest first lateral sides; wherein one of the microstrip lines is applied as an input end, and the other microstrip line is applied as an output end.

2. The dual-notch antenna of claim 1, wherein a length of each first lateral side ranges between 1.5 millimeters to 3.5 millimeters.

3. The dual-notch antenna of claim 1, wherein a length of each first lateral side ranges from 2.5 times to 5.5 times a length of each feeding side.

4. The dual-notch antenna of claim 1, wherein a length of each feeding side ranges from 2.5 times to 3.5 times a width of each microstrip line.

5. The dual-notch antenna of claim 1, wherein a length of each cove side is larger than a length of each feeding side.

6. The dual-notch antenna of claim 1, wherein a length of each second lateral side ranges from 3.5 times to 5 times of a length of each cove side.

7. The dual-notch antenna of claim 1, wherein a length of the first lateral sides of the two radiation members disposed on two distal ends of the string array is smaller than a length of the first lateral sides of the radiation members disposed between the two distal ends of the string array.

8. The dual-notch antenna of claim 1, wherein a length of each first lateral side ranges between 1.5 millimeters to 3.5 millimeters.

9. The dual-notch antenna of claim 1, wherein a length of each feeding side ranges from 2.5 times to 3.5 times a width of each microstrip line.

10. The dual-notch antenna of claim 1, wherein a length of each second lateral side ranges from 3.5 times to 5 times of a length of each cove side.

* * * * *